United States Patent [19]

Yokoyama et al.

[11] Patent Number: 5,040,731

[45] Date of Patent: Aug. 20, 1991

[54] ELECTROMAGNETIC FUEL INJECTION AND METHOD OF PRODUCING THE SAME

[75] Inventors: Mizuho Yokoyama; Hisanobu Kanamaru, both of Katsuta; Tokuo Kosuge, Ibaraki, all of Japan

[73] Assignee: Hitachi, Ltd., Tokyo, Japan

[21] Appl. No.: 434,572

[22] Filed: Nov. 13, 1989

Related U.S. Application Data

[63] Continuation of Ser. No. 112,148, Oct. 26, 1987, abandoned.

[30] Foreign Application Priority Data

Oct. 29, 1986 [JP] Japan ..... 61-255712

[51] Int. Cl.[5] ..... F02M 51/06

[52] U.S. Cl. ..... 239/585; 251/129.15

[58] Field of Search ..... 239/585; 251/129.15, 251/129.21

[56] References Cited

U.S. PATENT DOCUMENTS

| | | | |
|---|---|---|---|
| 4,313,571 | 2/1982 | Bellicardi et al. | 239/585 |
| 4,370,793 | 2/1983 | Karamaru et al. . | |
| 4,423,841 | 1/1984 | Palma | 239/585 |
| 4,455,982 | 6/1984 | Hafner et al. | 239/585 X |
| 4,519,547 | 5/1985 | Kubach et al. | 239/585 |
| 4,546,955 | 10/1985 | Beyer et al. | 251/129.15 |
| 4,564,145 | 1/1986 | Takada et al. | 239/585 |
| 4,567,910 | 2/1986 | Slavin et al. | 251/129.15 X |
| 4,643,359 | 2/1987 | Casey | 251/129.15 X |
| 4,651,926 | 3/1987 | Sasao et al. | 239/585 |

FOREIGN PATENT DOCUMENTS

| | | | |
|---|---|---|---|
| 0133704 | 3/1985 | European Pat. Off. . | |
| 3443001 | 5/1986 | Fed. Rep. of Germany | 239/585 |
| 60-119364 | 6/1985 | Japan . | |
| 2159211 | 11/1985 | United Kingdom . | |

*Primary Examiner*—Andres Kashnikow
*Assistant Examiner*—Christopher G. Trainor
*Attorney, Agent, or Firm*—Antonelli, Terry, Stout & Kraus

[57] ABSTRACT

An electromagnetic fuel injector suitable for use in an automotive engine has a cylindrical yoke constituting a body of the fuel injector, a solenoid coil and a stator core fixedly received in the cylindrical yoke, a movable core adapted to be attracted by the stator core, and a movable valve responsive to the movable core so as to be moved into and out of contact with a fuel injection valve seat in accordance with the balance of force between an electromagnetic force produced by the solenoid coil and a force produced by a spring received in the stator core. The stator core is coaxially received in the cylindrical yoke with a portion of the material of either one of the stator core and the yoke being plastically deformed into an annular groove formed in the opposing surface of the other of the stator core and the yoke. In consequence, the stator core and the yoke are coupled to and held on each other by the contracting force produced by the plastically deformed material in and around the annular groove. Also disclosed is a method of producing this fuel injector.

6 Claims, 4 Drawing Sheets

ELECTROMAGNETIC FUEL INJECTION AND METHOD OF PRODUCING THE SAME

This application is a continuation of application Ser. No. 112,148, filed on Oct. 26, 1987 now abandoned.

BACKGROUND OF THE INVENTION

The present invention relates to an electromagnetic fuel injector and a method of producing the same. More particularly, the invention is concerned with an electromagnetic fuel injector suitable for use in automotive engines, and also to a method of producing such a fuel injector.

Japanese Patent Laid-Open Publication No. 119364/1985, particularly FIG. 1 of the drawings attached thereto, shows a typical known electromagnetic fuel injector.

The fuel injector has a movable valve part which is integrally composed of a ball valve 11, a plunger rod 10 and a plunger 7 which serves as a movable core. In operation, an electric current is supplied to a solenoid coil 4 so that a magnetic circuit is formed so as to include the plunger 7, a stator core 2 and a yoke 6 so that a magnetic attracting force is generated to enable the stator core 2 to attract the plunger 7. When the supply of the electric current to the solenoid coil 4 is cut off, the magnetic attracting force is extinguished so that the movable valve part is reset to the original position by the force of the spring 5.

Usually, the mechanical connection between the stator 2 and the yoke 6 is attained by caulking by means of a jig which is moved downward onto the brim of an opening in the yoke so as to plastically deform the material of the yoke simultaneously over the entire circumference of the opening in the yoke.

This connecting method, however, is disadvantageous in that the center of the caulking force applied to the peripheral region of the connecting portion tends to be deviated from the center of the opening in the yoke, so that a difficulty is encountered in uniformly caulking the yoke. The yoke also tends to be deformed to cause an offset between the axes of the yoke and the stator core in the assembled state.

Furthermore, since the precision of the construction of a fuel injector depends on the radial size of the stator core and the length of the surface at which the stator core is coupled to the yoke, the caulking method mentioned above inherently has a possibility of a large eccentricity, resulting in a large fluctuation of the assembly precision in the axial direction which often reaches 0.06 mm (see FIG. 4).

In the known fuel injector in which the yoke and the stator are fixed to each other by caulking, it is necessary that a valve guide and a plunger rod guide have large lengths in order to ensure a smooth and precise reciprocating movement of the movable core. The use of such long valve guide and long plunger rod guide inevitably increases the size of the fuel injector and complicates the construction of the same.

SUMMARY OF THE INVENTION

Accordingly, an object of the present invention is to provide a fuel injector having a high assembly precision, as well as a method of producing the same, thereby overcoming the above-described problems of the prior art.

To this end, according to one aspect of the invention, there is provided an electromagnetic fuel injector comprising: a cylindrical yoke constituting a body of the fuel injector; a solenoid coil and a stator core fixedly received in the cylindrical yoke; a movable core adapted to be attracted by the stator core; and a movable valve responsive to the movable core so as to be moved into and out of contact with a fuel injection valve seat in accordance with the balance of force between an electromagnetic force produced by the solenoid coil and a force produced by a spring received in the stator core; wherein the stator core is coaxially received in the cylindrical yoke with a portion of the material of either one of the stator core and the yoke being plastically deformed into an annular groove formed in the opposing surface of the other of the stator core and the yoke, whereby the stator core and the yoke are coupled to and held on each other by the contracting force produced by the plastically deformed material in and around the annular groove.

According to another aspect of the invention, there is provided a method of producing an electromagnetic fuel injector of the type having a cylindrical yoke constituting a body of the fuel injector, a solenoid coil and a stator core fixedly received in the cylindrical yoke, a movable core adapted to be attracted by the stator core, and a movable valve responsive to the movable core so as to be moved into and out of contact with a fuel injection valve seat in accordance with the balance of force between an electromagnetic force produced by the solenoid coil and a force produced by a spring received in the stator core, the method comprising the steps of: holding the yoke between a center guide and an outer guide such that the inner and outer peripheral surfaces of the yoke are contacted and guided by the center guide and the outer guide, respectively; coaxially placing the stator core in the yoke while guiding the stator core by the center guide; locally pressing the peripheral edge portion of either one of the yoke and the stator core so as to cause a portion of material of the pressed member to plastically flow in a direction substantially perpendicular to the pressing force into an annular groove formed in the opposing surface of the other of the yoke and the stator core, thereby coupling the yoke and the stator core by the contracting force of the plastically deformed material in and around the annular groove.

The above and other objects, features and advantages of the present invention will become clear from the following description of the preferred embodiment when the same is read in conjunction with the accompanying drawings.

BRIEF DESCRIPTION OF THE DRAWINGS

FIG. 3A is a cross-sectional view showing how the amount of offset between the yoke and stator is measured for purposes of the graph of FIG. 3;

FIG. 4A is a cross-sectional view showing how the axial gap between the yoke and stator core is measured for purposes of the graph of FIG. 4.

DESCRIPTION OF THE PREFERRED EMBODIMENTS

Figure 1:
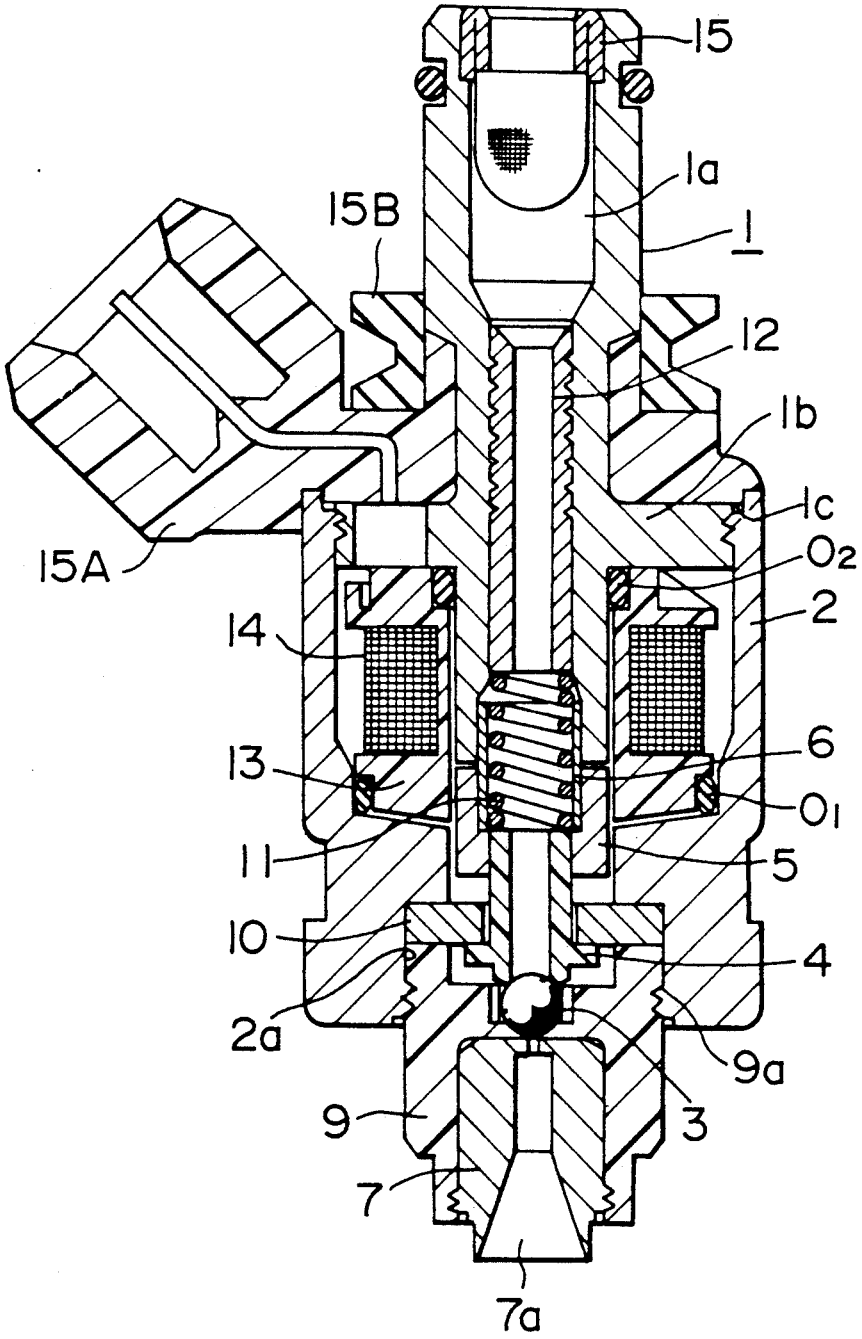
FIG. 1 is a longitudinal sectional view of a fuel injector embodying the present invention.

Referring to FIG. 1, a stator core 1 has a central bore constituting a fuel passage 1*a*. The stator core 1 also has a collar 1*b* formed on the outer peripheral surface at an axially intermediate portion thereof. An annular coupling groove 1*c* is formed in an upper portion of the outer peripheral surface of the collar 1*b*.

As will be understood from this Figure, the coupling groove 1*c* has an uneven cross-section having a substantially W-like shape. A cylindrical yoke 2 has a portion surrounding the stator core 1. A part of the inner peripheral portion of the cylindrical yoke 2 has been plastically deformed to fill the coupling groove so as to couple the cylindrical yoke 2 onto the stator core 1. An insulating bobbin 13, having a resin-molded annular exciting coil 14, fits in the space between the outer peripheral surface of the stator core 1 and the inner peripheral surface of the yoke 2, through the intermediates of "O" rings $O_1$ and $O_2$.

The stator core 1 has a central bore 1*a* which receives a cylindrical adjusting sleeve 12 which is fixed therein by caulking effected from the outer side of the stator core 1. A ball valve 3 disposed on the lower end of the stator core 1 is held on the lower end of a cylindrical plunger rod 4 which in turn is press-fit to the inner side of a cylindrical plunger 5 which opposes the stator core 1 leaving a predetermined axial gap therebetween. A guide ring 6 made of a non-magnetic material and having one end connected by, for example, press-fit in the plunger 5 while the other end is slidably received in the bore of the stator core 1. A spring 11 is disposed in the guide ring 6 with its both axial ends acting on the plunger rod 4 and the adjusting sleeve 12 so as to normally bias the ball valve 3 in the closing direction.

The fuel injector further has a nozzle 7 having a nozzle port 7*a*. The nozzle 7 is disposed coaxially with the valve guide 9 and is fixed to the latter as the material of the outer peripheral portion thereof is locally and plastically deformed to fill an annular groove 9*a* formed in the inner peripheral surface of the valve guide 9.

The valve guide 9 is disposed in a cylindrical recess 2*a* formed in the lower end surface of the yoke 2, through the intermediary of a C-shaped washer 10.

The fixing of the valve guide 9 to the yoke 2 is attained by causing a portion of the yoke 2 to be plastically deformed into an annular groove 9*a* formed in the outer peripheral surface of the valve guide 9 so as to fill this annular groove 9*a*.

The stator core 1 and the yoke 2 are capped with a plastic jacket 15 molded from a plastic. The plastic jacket 15 is provided at its one end with a terminal plug 15A through which lead wires are extended and a rubber bush 15B is seated on the plastic jacket 15.

A reference numeral 15C denotes a metallic filler disposed in the fuel passage.

The fuel injector of the invention having the described construction is assembled by a method which will be described hereinunder.

Figure 2:
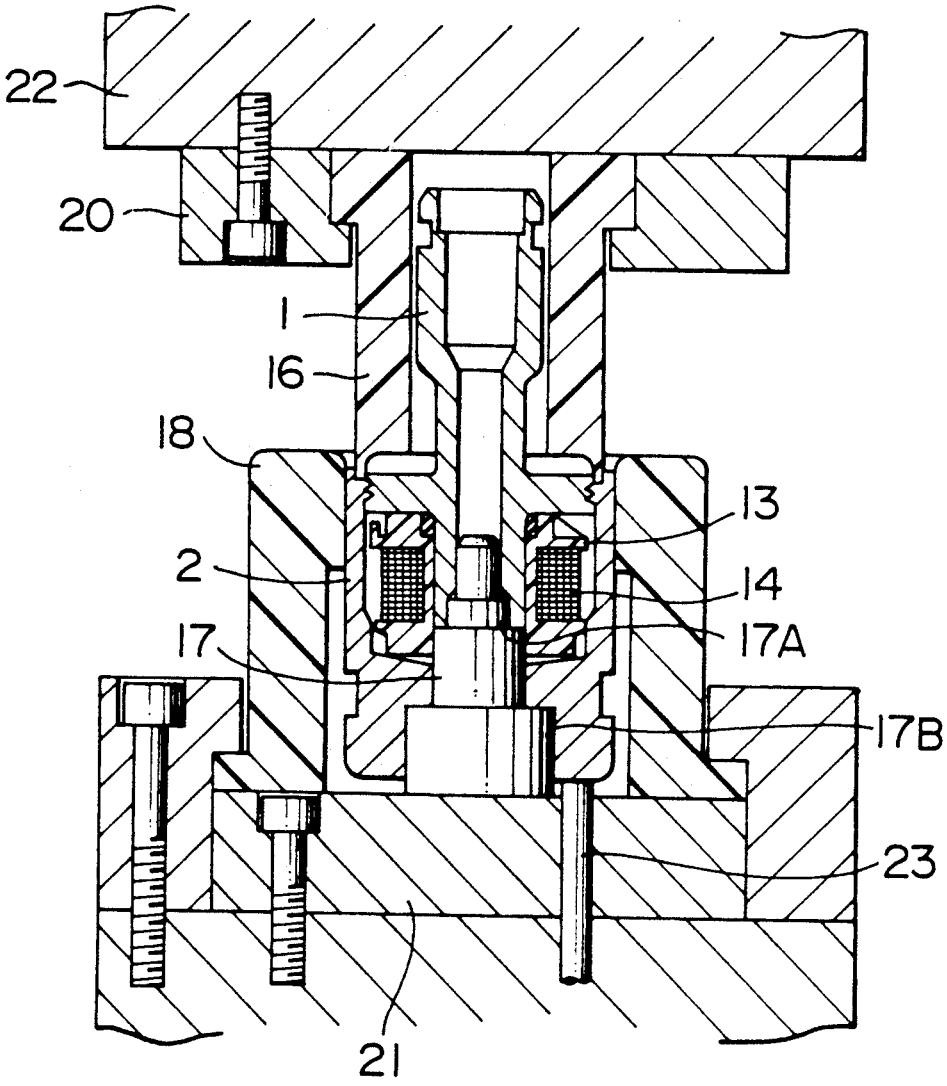
FIG. 2 is a longitudinal sectional view of an essential portion of the fuel injector shown in FIG. 1, illustrating particularly the manner in which a stator core is fixed to a yoke.

Referring to FIG. 2, the yoke 2 is immovably set on a center guide 17 which is sized to fit in the bore of the yoke 2 so as to guide the yoke 2. At the same time, the yoke 2 is held at its outer peripheral surface by an outer guide 18 which is fixed to a lower die 21. Subsequently, the solenoid coil 14 is placed on and around the guide 17 together with the insulating bobbin 13.

The stator core 1 is then brought into axial alignment with the yoke 2 and is slid along the guide 17 so as to be set in the yoke 2 coaxially therewith.

Subsequently, a punch 16, which is set on a press ram 22 through a fixing plate 20, is lowered while being guided by the inner peripheral surface of the yoke 2. In consequence, an annular processing tooth on the lower end of the punch 16 locally and vertically presses the inner peripheral edge portion of the axial end surface of the yoke 2 near the coupling portion. The pressing force causes a portion of the material of the yoke 2 to plastically flow in a direction substantially perpendicular to the pressing direction into a coupling groove formed in the outer peripheral surface of the stator core 1, thereby coupling the stator core 1 and the yoke 2 to each other. After the coupling, the press 22 and, hence, the punch 16 are raised and knock-out pins 23 are activated to eject the assembled part.

Subsequently, the adjusting sleeve 12 is fixed in the thus assembled part, and the plunger rod 4 which has been separately assembled is inserted through the spring 11 and the C-shaped washer 10. Then, the valve guide 9 having the ball valve 3 set in the center thereof and provided with the nozzle 7 fixed thereto is placed in the bore of the yoke 2, and the inner peripheral edge portion of the yoke 2 is locally and vertically pressed in the same manner as that explained above, so that a portion of the material of the yoke 2 plastically flows in a direction substantially perpendicular to the pressing direction into a coupling groove 9*a* formed in the outer peripheral surface of the valve guide 9, whereby the valve guide 9 is coupled to the yoke 2.

In the described method of the invention, the coupling between the yoke 2 and the stator core 1 is conducted while the yoke 2 and the stator core 1 are coaxially guided at their inner peripheral surfaces by a common guide 17. Namely, the stator core 1 is located by the guiding peripheral surface 17A of the guide 17 while the yoke 2 is located by the guiding peripheral surface 17B of the guide 17 so that the yoke 2 and the stator core 1 are precisely held coaxially with each other during the coupling operation, thus assuring a high degree of axial alignment between the yoke 2 and the stator core 1. In addition, the coupling portion is not subjected to any large external caulking force but is merely locally deformed plastically so that a high degree of dimensional precision is maintained in the connection between the yoke 2 and the stator core 1. Furthermore, the coupling by the local plastic deformation can easily be effected by a simple press, so that the method of the described embodiment can suitably be employed in mass-production.

The coupling of the valve guide also is effected by a local plastic deformation caused by an axial pressing force, so that the high precision of the coupling is attained between the valve guide and the yoke, without causing any degradation in the precision of the coupling between the yoke 2 and the stator core 1 attained by the above-mentioned plastic deformation.

Figure 3:
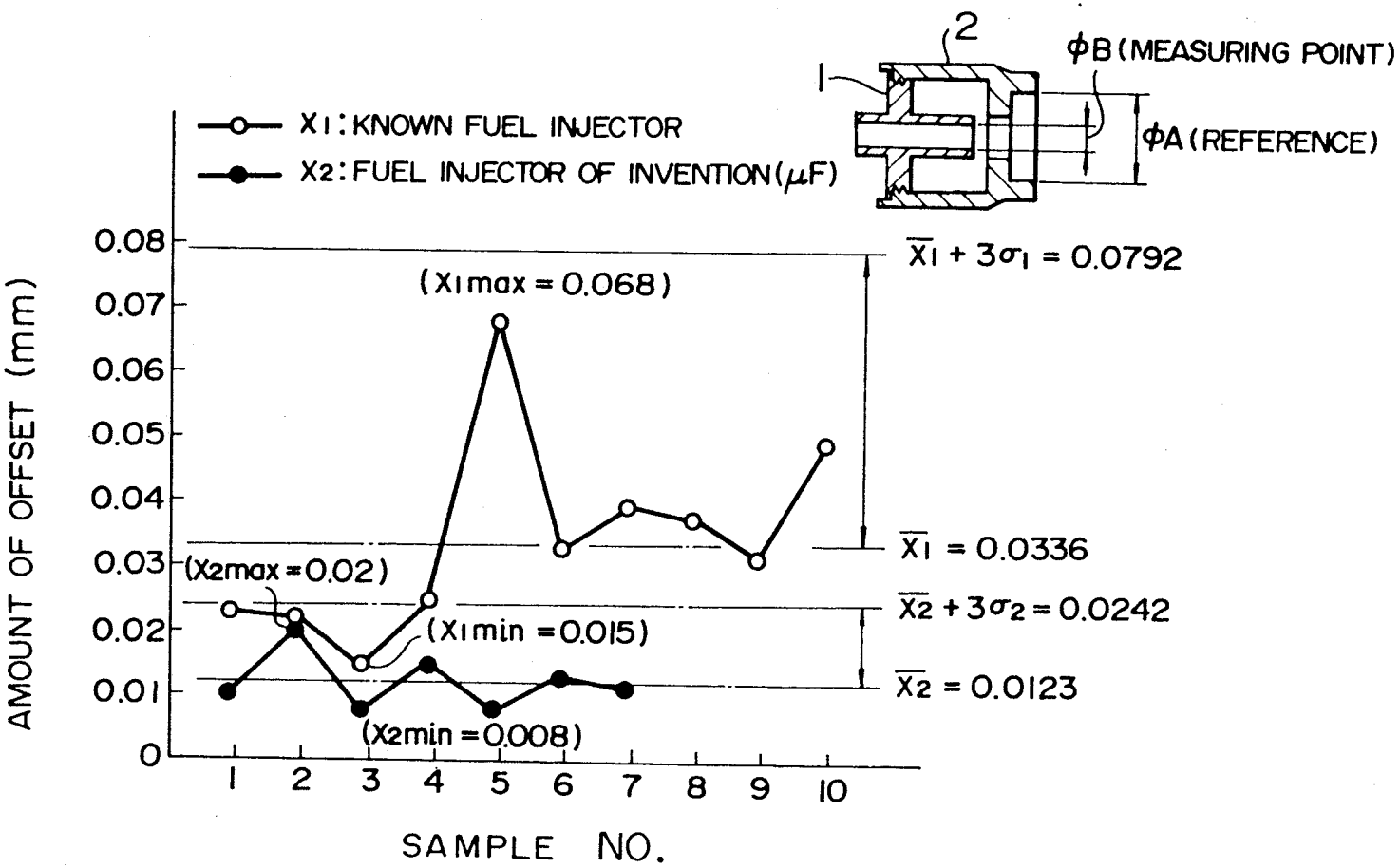
FIG. 3 is a graph illustrating the fluctuation in the assembly precision in the assembly of the fuel injector of the present invention in comparison with that in the fuel injector.

FIG. 3 shows the amount of fluctuation in the assembly precision, particularly the amount of offset between the axes of the yoke 2 and the stator core 1, as observed in a fuel injector assembled by the method of the invention and in a known fuel injector which has been assembled by caulking. From this Figure, it will be seen that the amount of offset in the fuel injector of the present invention is as small as ⅓ that in the known fuel injector.

Figure 4:
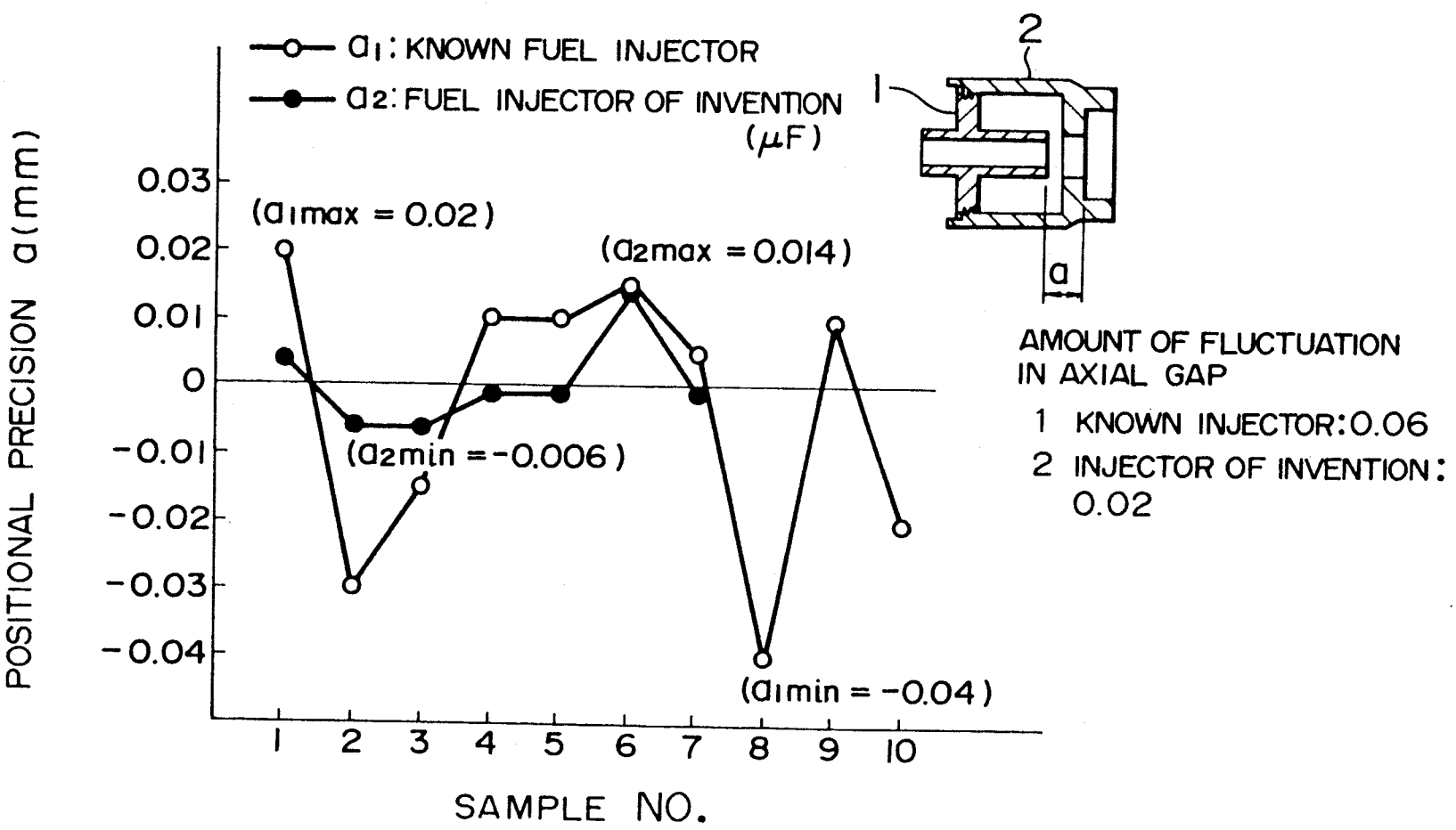
FIG. 4 is a graph illustrating the precision assembly of the fuel injector in accordance with the present invention and that of a prior art fuel injector.

FIG. 4 shows the degree of assembly precision in terms of fluctuation in the axial gap a between the yoke 2 and the stator core 1. It will be seen that the fuel injector the invention is superior to the known fuel injector also in the assembly precision in terms of the axial gap.

From FIGS. 3 and 4, it will be understood that the present invention ensures a higher reliability of the fuel injector as the product, and offers a higher efficiency in the mass-production of the fuel injector.

It is also to be understood that, in the fuel injector of the invention, a high degree of axial alignment between the yoke 2 and the stator core 1 is attained and, in addition, the reciprocating movement of the movable part including the ball valve 3, plunger rod 4 and the plunger 5 is smoothed by virtue of the ring 6 fixed to the plunger 5 so as to slide along the inner peripheral surface of the stator core 1. This in turn eliminates the necessity for large lengths of the valve guide and the plunger rod which are essentially required in the known fuel injectors. In consequence, the present invention also offers a compact design of the fuel injector.

In consequence, the present invention enables the stator core and the yoke to be assembled together with a high degree of easiness and reliability, thereby to ensure a highly reliable and precise construction of the fuel injector.

What is claimed is:

1. An electromagnetic fuel injector comprising:

a cylindrical yoke constituting a body of said fuel injector, said yoke having an axial bore at an upper part therein and an axially penetrating hole communicated with the bore in a bottom part thereof, the hole having a diameter smaller than that of the bore;

a solenoid coil and a stator core received in the axial bore of said cylindrical yoke, said stator core having a flange portion;

a movable core disposed in said penetrating hole coaxially with said stator core and being adapted to be attracted by said stator core; and a movable valve responsive to said movable core so as to be moved into and out of contact with a fuel injection valve seat in accordance with the balance of force between an electromagnetic force produced by said solenoid coil and a force produced by a spring received in said stator core;

wherein an inner peripheral surface of said cylindrical yoke defining the bore is formed to be substantially straight in an axial direction thereof;

said flange of said stator core is fitted in the inner peripheral surface of said cylindrical yoke, said flange having an engagement groove in an outer peripheral surface portion thereof; and means precisely positioning said stator core and said cylindrical yoke in coaxial relationship with respect to each other without cooperation of the stator core with an axially facing, stepped surface on the cylindrical yoke, said means consisting essentially of a coupling formed between said inner peripheral surface of the yoke and the outer peripheral surface portion of the flange of the stator core wherein a part of the material of an edge portion of the inner peripheral surface of said yoke which has been plastically deformed locally is forced into the engagement groove in the outer peripheral surface portion of the flange of said stator core by an elastic compressive stress therein, so that said stator core and said yoke are coupled to and held on each other.

2. An electromagnetic fuel injector according to claim 1, wherein said engagement groove has a substantially W-shaped cross-section when taken in a plane parallel to the axis of said fuel injector.

3. An electromagnetic fuel injector according to claim 1, wherein said yoke is made of a material harder than that of the material of the stator core.

4. An electromagnetic fuel injector according to claim 1, wherein said yoke has an axial end surface in the vicinity of said coupling between said stator core and said yoke so that an axially applied force can effect the plastic deformation.

5. An electromagnetic fuel injector according to claim 4 wherein said engagement groove has a substantially W-shaped cross-section when taken in a plane parallel to the axis of said fuel injector.

6. An electromagnetic fuel injector according to claim 4, wherein either one of said stator core and said yoke which is plastically deformed is made of a material harder than that of the material of the other.

* * * * *